US006278349B1

(12) United States Patent
Giffin

(10) Patent No.: US 6,278,349 B1
(45) Date of Patent: Aug. 21, 2001

(54) APPARATUS FOR MAGNETIZING A METALLIC DRIVING TOOL

(75) Inventor: Jeffrey Justin Giffin, Boulder, CO (US)

(73) Assignee: Giffen Tec Inc., Boulder, CO (US)

( * ) Notice: Subject to any disclaimer, the term of this patent is extended or adjusted under 35 U.S.C. 154(b) by 0 days.

(21) Appl. No.: 09/501,064

(22) Filed: Feb. 9, 2000

(51) Int. Cl.[7] ..... H01F 13/00; H01F 7/20
(52) U.S. Cl. ..... 335/284; 335/306
(58) Field of Search ..... 335/283, 284, 335/296–306

(56) References Cited

U.S. PATENT DOCUMENTS

| | | | | |
|---|---|---|---|---|
| 2,370,800 | * | 3/1945 | Kind et al. | 40/493 |
| 3,007,504 | | 11/1961 | Clark | 145/50 |
| 3,392,767 | | 7/1968 | Stillwagon, Jr. | 145/50 |
| 3,538,792 | | 11/1970 | Stillwagon, Jr. | 76/101 |
| 3,662,303 | * | 5/1972 | Arllof | 335/284 |
| 5,586,847 | | 12/1996 | Mattern, Jr. et al. | 408/239 |
| 5,724,873 | | 3/1998 | Hillinger | 81/451 |
| 5,861,789 | * | 1/1999 | Bundy et al. | 335/285 |

* cited by examiner

*Primary Examiner*—Ramon M. Barrera
(74) *Attorney, Agent, or Firm*—Sheridan Ross P.C.

(57) ABSTRACT

An apparatus is provided for removable interconnection to a metallic bit driving tool used to drive screws and other attachment hardware and to provide a magnetizing force at the tip of the bit driving tool. The apparatus may be used in conjunction with a typical power drill or other similar device.

22 Claims, 6 Drawing Sheets

APPARATUS FOR MAGNETIZING A METALLIC DRIVING TOOL

FIELD OF THE INVENTION

The present invention relates to hand tools, and more specifically hand tools used to magnetize driving bits which are adapted for use with attachment hardware such as screws.

BACKGROUND OF THE INVENTION

Hand tools are used by craftsman, electricians, homeowners, carpenters and a variety of others to construct buildings, repair household furniture and appliances and perform an endless variety of other tasks and functions. One of the most popular and useful hand tools is a handheld screwdriver or an electric or battery operated power drill adapted with a screwdriver bit. These tools are used to drive screws and other metallic attachment hardware devices in a quick, efficient manner.

To improve the efficiency and speed of a handheld screwdriver or power driven driving tool or bit, it is advantageous that the bit be magnetized to hold the metallic screw. This enables the screw to be temporarily attached to the driving bit and allows the user to have another hand free for holding the tip of the screw for proper alignment prior to turning the screw.

Previous attempts have been made to magnetize metallic driving bits such as screwdrivers, allen wrenches or other tools. These include small rings which are slid over the metallic driving bit to exert a magnetic gauss to the end of the driving bit, which in turn holds the screw on other attachment hardware. Unfortunately, these magnetic rings typically only provide a small contact surface with the metallic driving tool and thus do not provide a sufficient magnetic gauss to be overly effective. Additionally, their close tolerance to the exterior diameter of the metallic driving tool often make them difficult to attach. Finally, the orientation of the magnets are not optimally positioned to provide the most efficient magnetic gauss and hence magnetic force delivered at the driver bit where it is required.

An example of one type of magnetizing device is disclosed in U.S. Pat. No. 5,724,873. In this device, a ring magnet is used which is positioned close to the screw or other fastener. Due to the strength of the magnet, the fastener is attracted to the driver bit, although the driver bit is never sufficiently magnetized. This system is not overly effective since the orientation of the magnets do not provide an overly effective magnetic gauss at the driver bit. Additionally, very large and expensive magnets are often required. Due to their size and positioning near the driving bit, these larger magnets often obscure the user's view of the driving bit and/or screw.

Thus, there is a significant need for a small, inexpensive device which can be removably attached to a metallic driving bit to provide a sufficient magnetic gauss at the metallic driving bit to securely hold attachment hardware such as screws.

SUMMARY OF THE INVENTION

It is thus an object of the present invention to provide a portable magnetizing device which can be quickly attached to a conventional metallic driving bit to magnetize the bit to hold screws and other types of fastening hardware. The conventional metallic driving tool may include a screwdriver, Allen wrench or another similar device which may be used independently or in conjunction with a power tool such as an electric drill.

It is a further aspect of the present invention that the magnetizing device be extremely efficient, thus allowing the size and power of the magnets to be small and extremely cost effective. The efficiency of the device is achieved by the orientation of the magnets, and allowing a plurality of magnets to come into direct contact with the metallic driving tool.

It is a further object of the present invention to provide a magnetizing device which is easy to install and which maximizes the magnetic gauss present at the tip of the metallic driving tool. Thus, in one preferred embodiment of the present invention, the magnets are positioned in apertures and reciprocate therein based on the positioning of the polarities of the magnets in the apertures. Thus, the magnets are retracted from a central aperture until a metallic driving tool is inserted into the central aperture, at which time the magnets are drawn toward the magnetic driving tool and thus providing a magnetic gauss at the end of the tool, to attach a metallic fastening device such as a screw.

Thus, in one aspect of the present invention, an apparatus adapted for magnetizing a metallic driving tool is provided, comprising:

a) a substantially non-magnetic housing having an outer circumference, an inner circumference defining a central aperture and a plurality of apertures extending between said outer circumference and said inner circumference;

b) a magnetic material comprising opposing north and south poles slidingly positioned within each of said apertures of said non-magnetic housing to reciprocate therein, said magnetic material positioned with similar poles positioned adjacent said inner circumference, wherein said magnet materials oppose each other until the metallic driving tool is inserted in said central aperture, wherein each of said magnetic materials reciprocate within said plurality of apertures to engage an outer surface of the driving tool; and c) a non-magnetic press ring extending around said outer circumference of said non-magnetic housing to maintain said magnetic material within said apertures.

DETAILED DESCRIPTION OF THE PREFERRED EMBODIMENT

Figure 1:
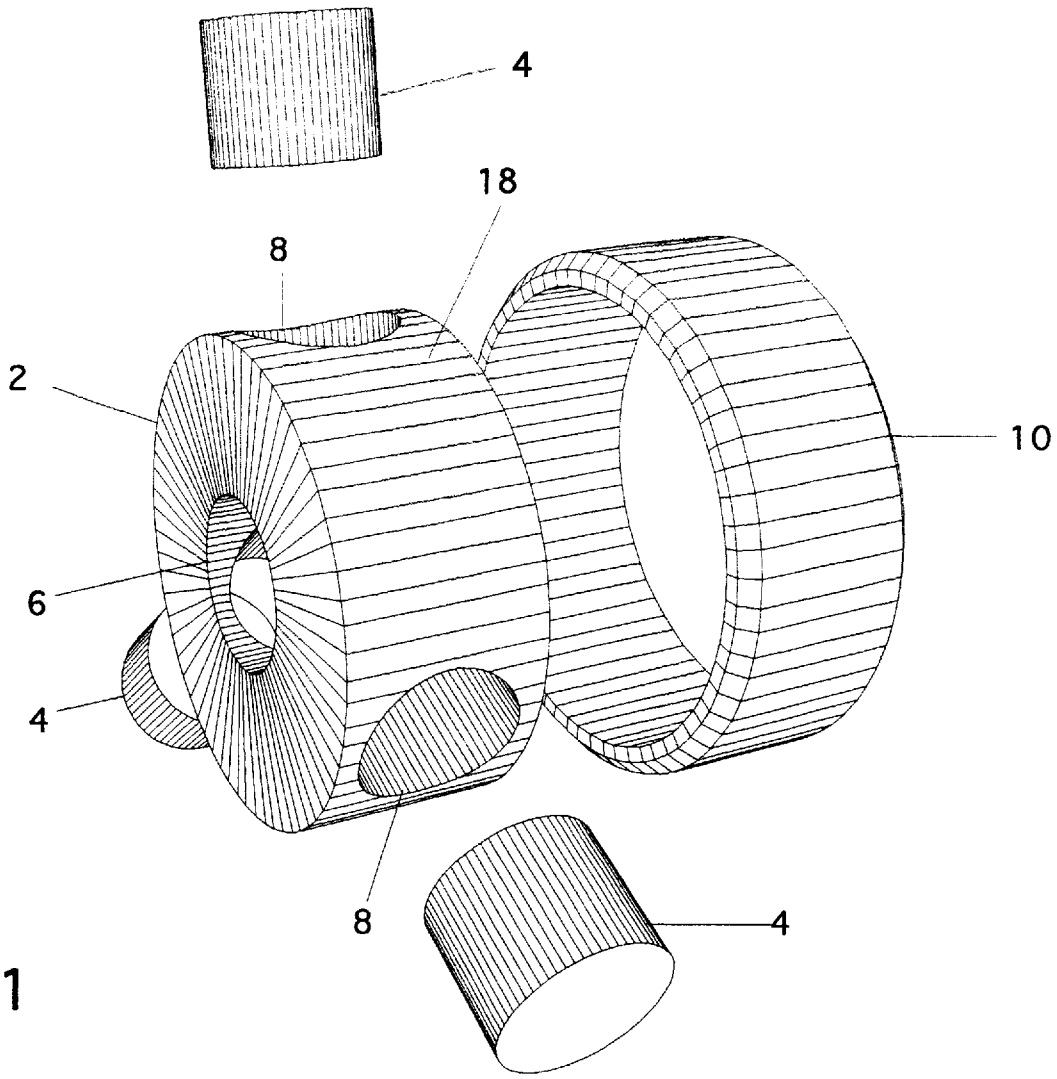
FIG. 1 is a front exploded perspective view of the present invention showing the non-magnetic housing, reciprocating magnets and press ring.

Referring now to the drawings, FIG. 1 is a exploded front perspective view of the present invention and generally identifying the various components associated therein. More specifically, the magnetizing ring is comprised of a non-magnetic housing 2 with a central aperture 6 extending therethrough. The central aperture 6 is designed to receive a metallic driving tool 20 such as a screw driver or allen wrench. The central aperture 6 is further interconnected by a plurality of opposing apertures 8 which extend generally from the central aperture to the outer circumference of the non-magnetic housing 2 and are designed to receive a plurality of reciprocating magnets 4. A press ring 10 may additionally be used in a preferred embodiment of the present invention to fit around the outer circumference of the non-magnetic housing 2 and to prevent the magnets 4 from extending beyond the outer circumference of the non-magnetic housing 2. Alternatively, the magnet apertures 8 may be tapered to prevent the magnets 4 from extending beyond the outer circumference of the non-magnetic housing 2.

Figure 2:
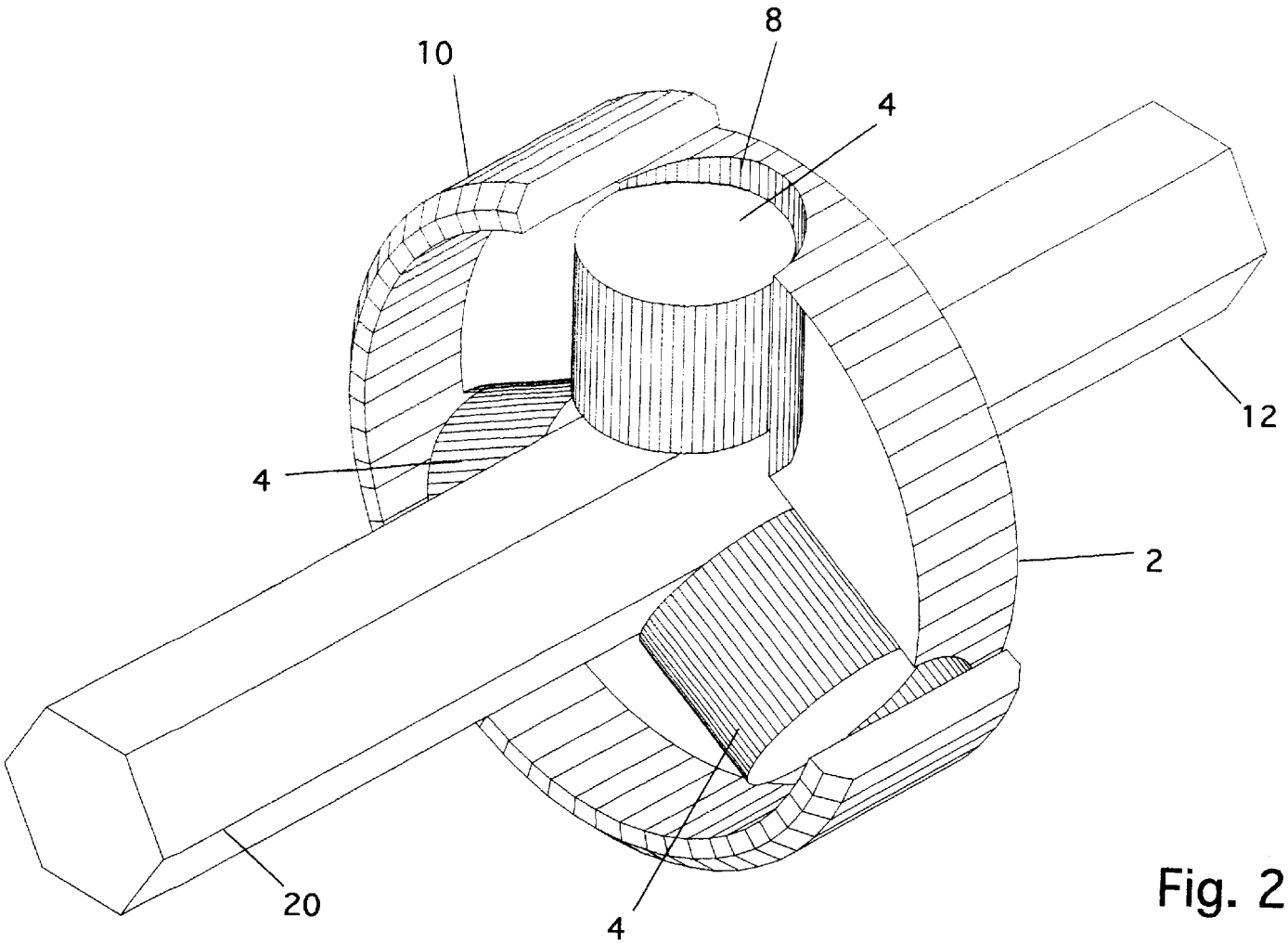
FIG. 2 is a cut-away front perspective view of the device of FIG. 1; with a driver bit shown positioned within a central aperture.

Referring now to FIG. 2, the magnetizing ring of the present invention is shown in an exploded view with a metallic driving bit 12 inserted through the central aperture 6. More specifically, as the metallic driving tool 12 is inserted into the central aperture 6, the reciprocating magnets 4 are attracted to the metallic driving bit. This magnetic attraction allows the magnets 4 to reciprocate within the magnet apertures 8 and come in contact with the metallic driving bit 12. Thus, in a preferred embodiment, at least three magnets 4 have a magnetic contact surface 16 in contact with the metallic driving bit 12 and which provide a magnetic gauss force at the metallic driving bit 12. This magnetic gauss force is then transferred through the metallic driving bit 12 to the metallic driving tool tip 20 which is in contact with a screw or other metallic attachment mechanism. The purpose of magnetizing the metallic driving tool tip 20 is to hold the attachment hardware such as a screw in operable engagement with the metallic driving tool tip 20 during use to assist the user of a screwdriver or other type of driving tool.

Figure 3:
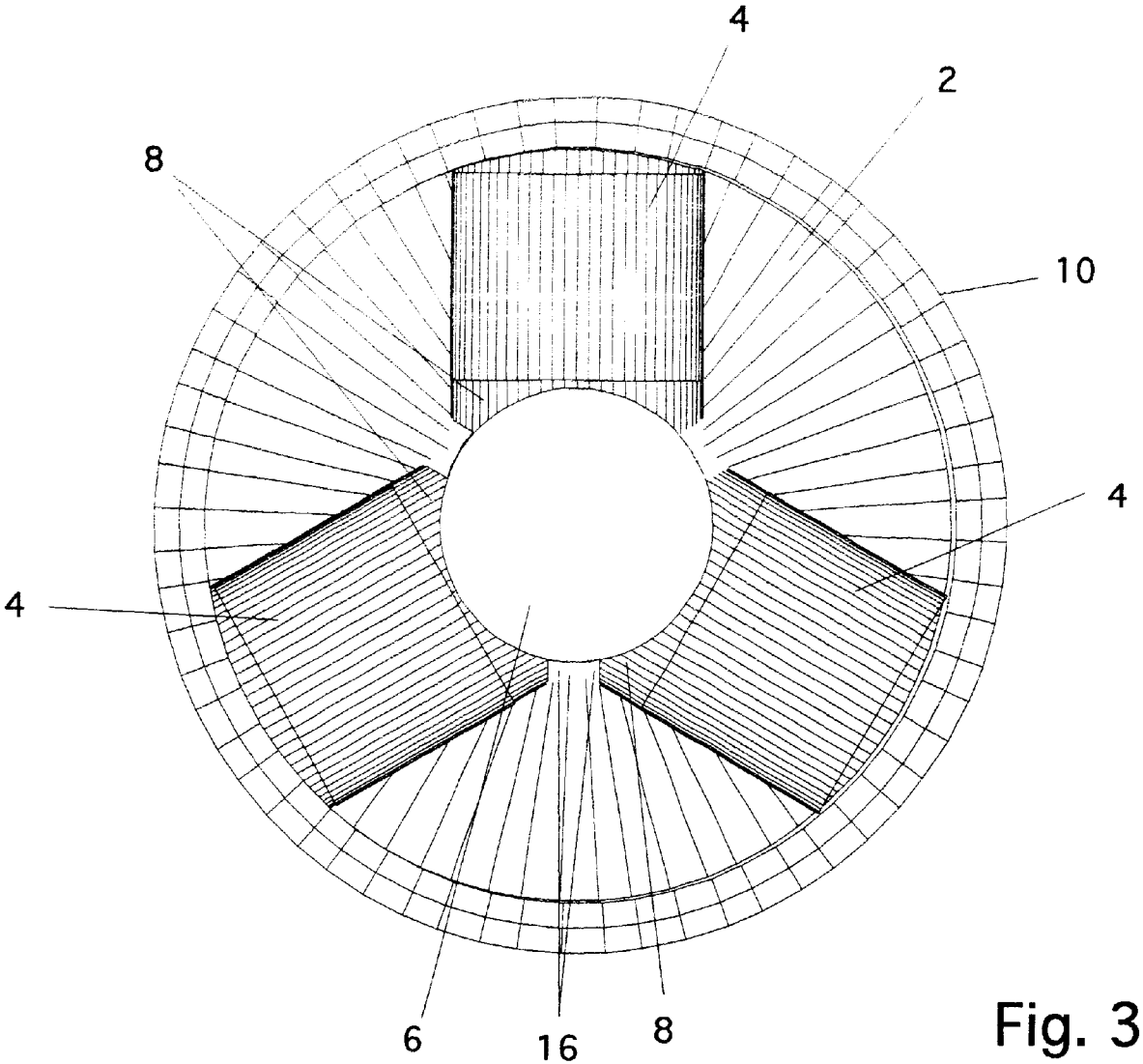
FIG. 3 is a cut-away end view of the device shown in FIG. 1 without any type of driving bit inserted therein and the magnets positioned away from each other in the magnet apertures.

Referring now to FIG. 3, a cross-section end view of the present invention is provided which shows the various components associated therein. More specifically, this particular drawing shows the central aperture 6 positioned generally within the center of the non-magnetic housing 2 and additionally showing the orientation of the magnet apertures 8 extending outwardly from the central aperture 6 to the non-magnetic housing outer circumference 18. In a preferred embodiment, the magnet apertures 8 are positioned at approximately 120° angles from one an another in an opposing relationship which allows the optimum contact surface of the magnets 4 with the magnetic driving tool 22. As seen in FIG. 3, when a non-metallic driving tool 12 is not inserted in the central aperture 6, the magnets 4 reciprocate away from the central aperture 6 within the magnet apertures 8 until they engage the press ring 10. This reciprocation within the magnet apertures 8 is a result of the natural north-south polarity of the magnets 4, and by manufacturing the magnetic apertures 8 with a slightly larger diameter than the magnets 4. When a non-metallic driving tool 12 is not inserted in the central aperture 6, the magnetic polarity of the magnets 4 causes the magnets 4 to oppose one another and thus reciprocate away from the central aperture 6. When a metallic driving tool 12 is inserted into the central aperture 6, the magnets are attracted toward the metallic driving tool 12 and thus reciprocate back toward the central aperture 6.

In an alternative embodiment of the present invention, the press ring 10 is not positioned around the non-magnetic housing outer circumference 18 since the magnet apertures 8 are slightly tapered with a larger diameter positioned near the central aperture 6 and a smaller diameter positioned near the non-magnetic housing outer circumference 18. Thus, when the magnets oppose one another and reciprocate within the magnet apertures 8, they are restricted from traveling past the non-magnetic housing outer circumference 18 by engaging the reduced interior diameter of the magnet apertures 8. This particular embodiment is not presently shown in the drawings but can be appreciated by one skilled in the art.

Figure 4:
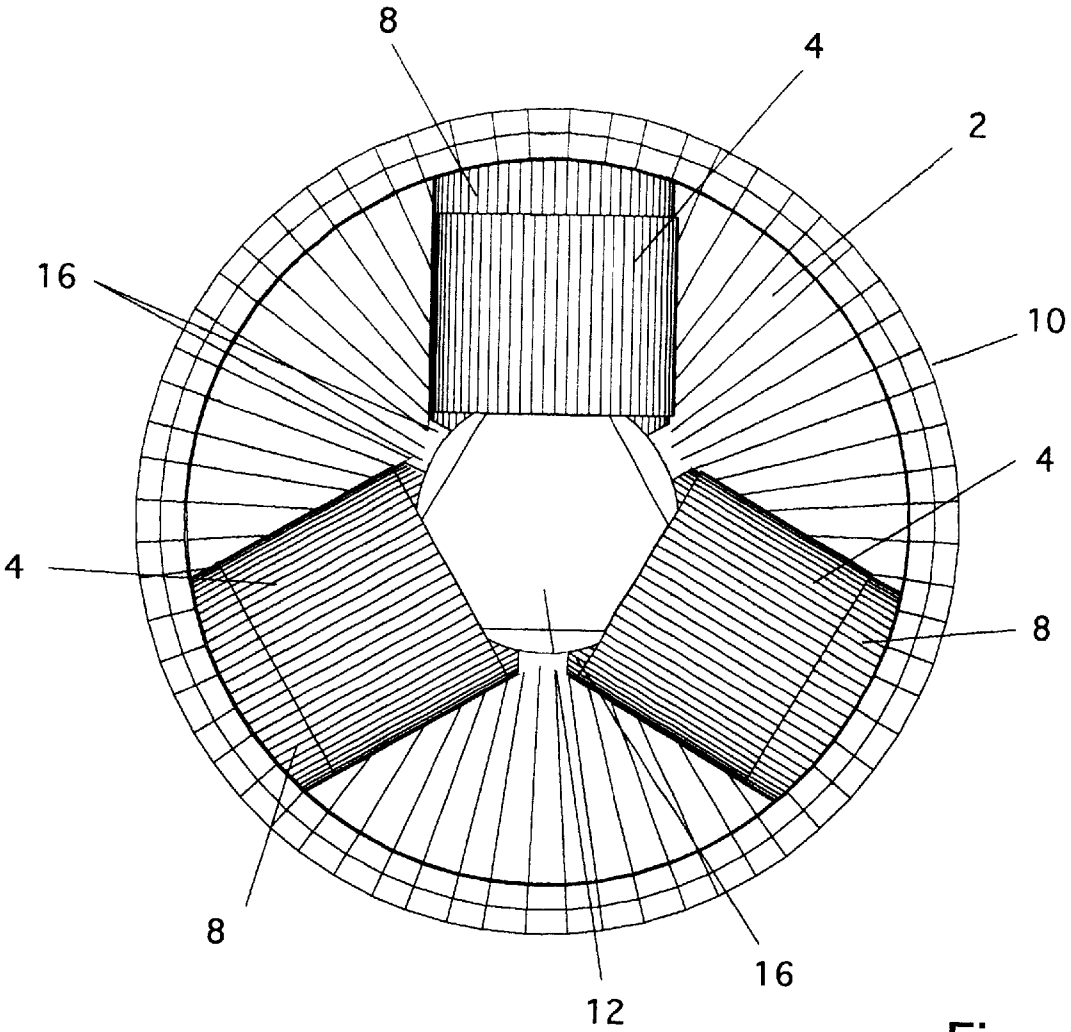
FIG. 4 is a cut-away end view of the device of FIG. 1 shown with a typical metallic driving bit inserted therein and the magnets in contact with the metallic driving bit.

Referring now to FIG. 4, the cut-away end view of the present invention is shown but in this particular drawing, a metallic driving tool 12 is shown inserted in the central aperture 6. As seen, when a metallic driving tool 12 is positioned in the central aperture 6, the magnets 4 are immediately drawn to the metallic surface of the driving tool 12 and thus reciprocate within the magnet apertures 8 until a magnet contact surface 16 is engaged with the metallic driving tool 12. As seen in FIG. 4, three different magnets are engaged to the metallic driving tool 12 at 3 distinct positions. This engagement with the metallic driving tool 12 at three distinct locations on the metallic driving tool 12 provides a substantial magnetic force to the metallic driving tool 12 which is transferred through the metallic tool to the metallic driving tool tip 20. Distinguishing FIG. 3 from FIG. 4, in FIG. 3 the reciprocating magnets 4 are in a position opposite the central aperture 6 when a non-metallic driving tool is not positioned in the central aperture 6, while in FIG. 4 the reciprocating magnets 4 are drawn toward the central aperture 6 to engage the metallic driving tool 12. Thus, until a metallic driving tool 12 is inserted into the central aperture 6, the reciprocating magnets 4 are withdrawn from the central aperture and thus provide a clear central aperture 6 opening for the insertion of the metallic driving tool 12.

Figure 5:
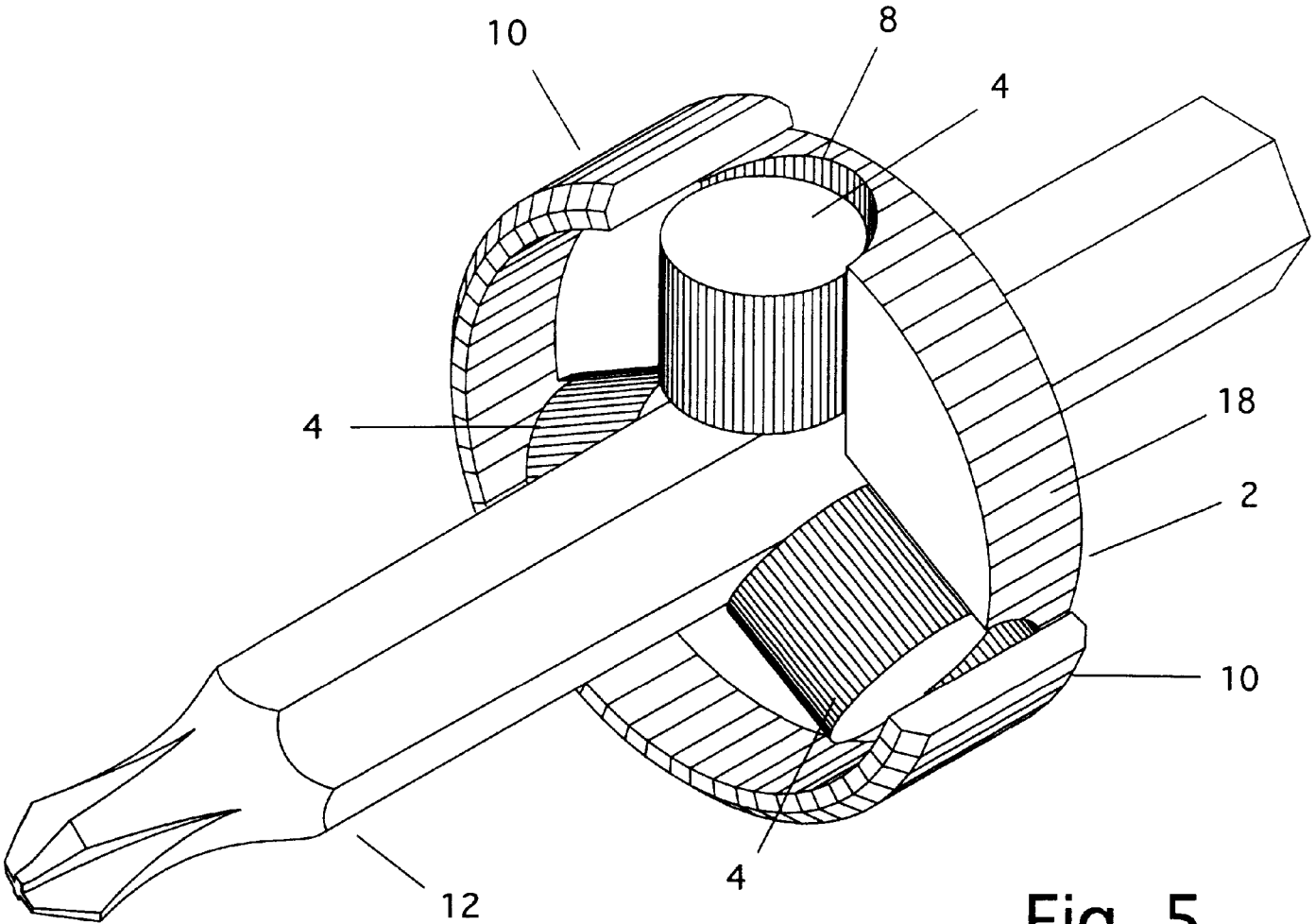
FIG. 5 is a front perspective of the device shown in FIG. 1 with a metallic driving tool inserted in the central aperture, and showing the magnets engaged to the driving tool to provide a magnetic force thereto.

Referring now to FIG. 5, an exploded or a cut-away front perspective view of the present invention is shown with a metallic driving tool 12 such as a screwdriver inserted through the central aperture 6. As shown in this particular drawing, the non-magnetic housing 2 preferably comprises a circular shape having a central aperture 6 extending therethrough. A plurality of magnet apertures 8 extend from the central aperture 6 to an non-magnetic housing outer circumference 18. The reciprocating magnets 4 are positioned within the magnet apertures 8 and have a diameter less than the magnet apertures 8 which allow the magnets 4 to reciprocate back and forth within the magnet apertures 8 between a position of use as shown in FIG. 5 and a non-position of use as shown in FIG. 3. The reciprocating motion of the magnets 4 are made possible by the natural north-south polarity of the magnets 4.

The reciprocating magnets 4 used in the present invention are preferably neodymium magnets positioned approximately 120° apart from the other magnets 4. The neodymium magnets have been found during testing to deliver approximately 375 gauss at the magnetic tool tip which is significantly better than standard magnets. Additionally, the orientation of the magnets is very important to the present invention. For example, when the same type of neodymium magnets are placed behind a magnetic driving tool, a gauss of approximately only 240 gauss is provided at the driving tool tip as opposed to the 375 gauss provided when all three magnets are opposing and perpendicular to the bit as provided in the present invention. As appreciated by one skilled in the art, although 120° is considered an optimal orientation of the magnets with respect to the metallic driving tool 12, other orientations could be used in other geometric forms to accomplish a similar purpose. Preferably, the neodymium magnets 4 have a dimension of 0.25 inch diameter by 0.1875 inch long. However, as appreciated by one skilled in the art, other sizes of magnets could be used based on various applications. However, this size has been found optimal for use in typical standard size electric and pneumatic drills which accommodate one-quarter inch driving bits. Additionally, the one-quarter inch standard size is typically used for handheld screwdrivers, alien wrenches and any other type of magnetic conductive materials which have a one-quarter inch or smaller exterior diameter.

The non-magnetic housing 2 as described is generally a circular shaped ring comprised of any variety of non-magnetic materials such as stainless steel, brass, aluminum, plastic, or even wood. The material must be non-magnetic to allow the reciprocation of the magnets 4 within the magnet apertures 8 positioned within the non-magnetic material. Further, the outer shape of the non-magnetic housing 2 is not critical to the present design, and other geometric configurations could be used to achieve the same purpose. Preferably, the diameters of the magnetic magnet apertures are 0.256 inches, which have been found to be optimum for receiving a 0.25 inch diameter magnet. The central aperture 6 extending through the non-magnetic housing 2 is preferably a 0.298 inch diameter shaft which is designed to accept any one-quarter inch or smaller metallic driving tool 12. In a preferred embodiment of the present invention, the diameter of the non-magnetic housing 2 is 0.745 inches, although larger sized magnets could of course be inserted in a non-magnetic housing 2 having a greater diameter. The width of the non-magnetic housing 2 in a preferred embodiment is 0.315 inches as is the non-magnetic press fit ring which extends around the outer circumference of the non-magnetic housing 2. Preferably, the press fit ring has a 0.739 inch inner diameter which extends around the outer diameter of the non-magnetic housing 2. Again the press ring 10 is comprised of a non-metallic material such as brass, aluminum, plastic, etc. to allow the proper reciprocation of the magnets within the magnet apertures 8.

Figure 6:
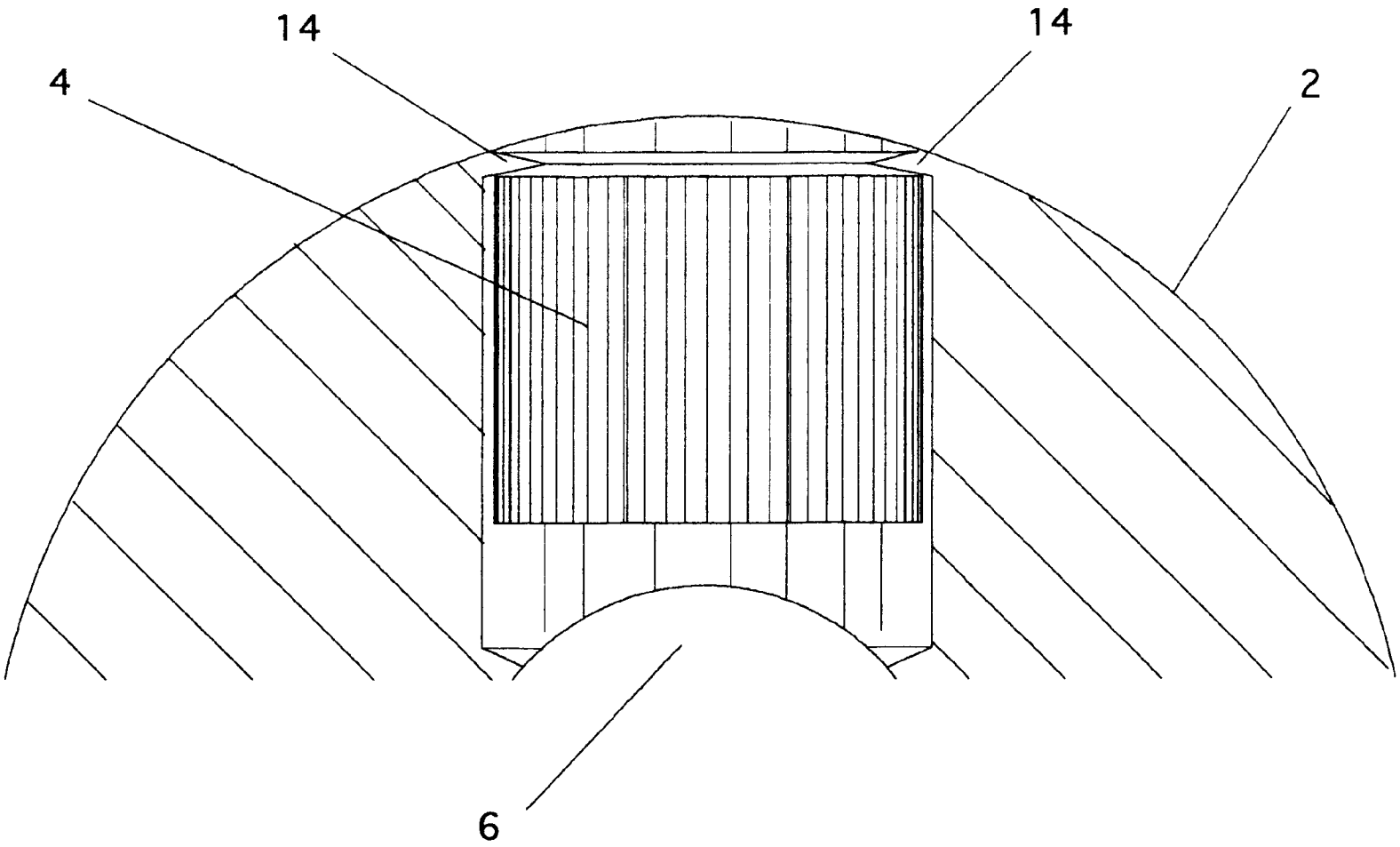
FIG. 6 is cutaway end view of the device shown in FIG. 1 without any type of driving bit inserted therein and the apertures having a tapered profile to prevent the magnets from extending outside of the non-magnetic housing.

FIG. 6 is a top plan view of an alternative embodiment of the present invention showing the non-magnetic housing 2, the central aperture 6, and a plurality of tapered apertures 14 which are tapered to prevent the magnets 4 from extending beyond the non-magnetic housing outer circumference 18. Thus, in this particular embodiment a press ring 10 is not necessary to prevent the magnets 4 from becoming disengaged from the device.

To assist the reader in the understanding of the present invention, the following is a list of the various components and the numbering associate therewith as depicted in the drawings:

2 Non-magnetic housing
4 Magnets
6 Ccentral aperture for driving tool
8 Apertures for magnets
10 Press ring
12 Metallic driving tool
14 Tapered aperture
16 Magnet contact surface
18 Non-magnetic housing outer circumference
20 Metallic driving tool tip

What is claimed is:

1. An apparatus adapted for magnetizing a metallic driving tool, comprising:

a) a substantially non-magnetic housing having an outer circumference, an inner circumference defining a central aperture and a plurality of magnet apertures extending between said outer circumference and said inner circumference;

b) a magnet comprising opposing north and south poles slidingly positioned within each of said magnet apertures of said non-magnetic housing to reciprocate therein, said magnets positioned with similar poles positioned adjacent said inner circumference, wherein said magnets oppose each other until the metallic driving tool is inserted in said central aperture, wherein each of said magnets are reciprocable within said plurality of apertures to engage an outer surface of the driving tool; and c) a non-magnetic press ring extending around said outer circumference of said non-magnetic housing to maintain said magnets within said apertures.

2. The apparatus of claim 1, wherein said magnets is comprised of neodymium.

3. The apparatus of claim 1, wherein said non-magnetic housing and press ring are comprised of brass.

4. The apparatus of claim 1, wherein said center aperture has a diameter of at least about 0.298 inches, wherein a 0.25 inch drive tool may be received therein.

5. The apparatus of claim 1, wherein said magnets are cylindrically shaped with a length of at least about 0.20 inches.

6. The apparatus of claim 1, wherein said longitudinal axis of said magnets are oriented in a direction substantially perpendicular to said central aperture.

7. The apparatus of claim 1, wherein said plurality of magnets delivers a magnetic gauss level of at least about 300 gauss at said metallic driving tool tip.

8. The apparatus of claim 1, wherein said metallic driving tool is a screwdriver.

9. The apparatus of claim 1, wherein said metallic driving tool is an allen wrench.

10. The apparatus of claim 1, wherein said plurality of magnet apertures extending between said inner circumference and said outer circumference are positioned approximately 120 degrees apart.

11. The apparatus of claim 1, wherein a first end of each of said magnets is positioned between said inner circumference and said outer circumference of said apparatus when a metallic driving tool is not positioned within said central aperture.

12. An apparatus adapted for magnetizing a metallic driving tool, comprising:

a) a non-magnetic housing having an outer diameter, an inner diameter and a plurality of apertures extending therebetween, said plurality of apertures having a tapered shape with a smaller diameter positioned proximate to said outer diameter;

b) a central aperture defined by said inner diameter which is adapted to receive the metallic driving tool; and c) a magnetic material comprising opposing north and south poles, respectively on a first end and a second end, each of said magnetic materials slidingly positioned within each of said plurality of apertures to reciprocate therein, but not extend beyond said smaller diameter, wherein said magnets oppose each other until the metallic driving tool is inserted in said center aperture, wherein each of said magnetic materials are adapted to engage an outer surface of said driving tools to magnetize the metallic driving tool.

13. The apparatus of claim 12, further comprising a non-magnetic press ring extending around an outer circumference of said non-magnetic housing to enclose said magnetic materials within said apertures.

14. The apparatus of claim 12, wherein said non-magnetic housing has a substantially circular shape.

15. The apparatus of claim 12, wherein said magnetic materials are comprised of neodymium.

16. The apparatus of claim 12, wherein said magnetic materials deliver at least about 300 gauss at said metallic driving tool.

17. The apparatus of claim 12, wherein said metallic driving tool is a screwdriver.

18. The apparatus of claim 12, wherein said apertures are positioned approximately 120 degrees apart, wherein said magnetic materials oppose each other until a metallic driving tool is inserted in said central aperture.

19. An apparatus with reciprocating magnetic materials adapted for removable interconnection to a driving bit positioned within a handheld tool, comprising:

a) a non-magnetic housing having an inner diameter which defines a central aperture, an outer diameter and a plurality of cavities extending between said inner diameter to a position proximate to said outer diameter; and b) a magnetic material having a north pole positioned on a first end and a south pole positioned on a second end, said magnetic materials positioned in sliding engagement within said cavities with either all of said north or said south poles positioned proximate to said central aperture, wherein said magnetic materials are reciprocable away from said central aperture until the driving bit is positioned within said central aperture, wherein said magnetic materials are attractable to and adapted to engage an exterior surface of the driving bit and magnetize the driving bit; and c) a non-magnetic press ring extending around said outer circumference of said non-magnetic housing to maintain said magnets within said apertures.

20. The apparatus of claim 19, wherein said cavities are oriented approximately 120 degrees apart.

21. The apparatus of claim 19, wherein sad magnetic materials are comprised of neodymium.

22. The apparatus of claim 19, wherein the longitudinal axis of said cavities are positioned at approximately a 90 degree angle in relation to said central aperture.

* * * * *